US005732635A

United States Patent [19]

McKoy

[11] Patent Number: 5,732,635

[45] Date of Patent: Mar. 31, 1998

[54] AMUSEMENT POWER-CABLE-PROPELLED AND CHANNEL-GUIDED BOAT RIDE STRUCTURE

[76] Inventor: Errol W. McKoy, 6403 Clubhouse Cir., Dallas, Tex. 75240

[21] Appl. No.: 661,365

[22] Filed: Jun. 11, 1996

[51] Int. Cl.[6] ..... A63G 33/00

[52] U.S. Cl. ..... 104/73; 104/53; 104/172.3; 104/60; 104/183; 104/173.1

[58] Field of Search ..... 104/53, 140, 139, 104/172.3, 70, 58, 60, 59, 67, 71, 72, 73, 173.1, 173.2, 178, 183

[56] References Cited

U.S. PATENT DOCUMENTS

| | | | |
|---|---|---|---|
| 357,790 | 2/1887 | Schaefer . | |
| 536,357 | 3/1895 | Palacio | 104/139 |
| 536,441 | 3/1895 | Morris . | |
| 849,970 | 4/1907 | Boyton . | |
| 1,358,305 | 11/1920 | Feltman | 104/59 |
| 1,397,939 | 11/1921 | Unger | 104/60 |
| 1,448,306 | 3/1923 | Lezert | 104/73 |
| 3,003,430 | 10/1961 | Hamel | 104/72 |
| 3,404,635 | 10/1968 | Bacon et al. | 104/73 |
| 3,690,265 | 9/1972 | Horibata | 104/70 |
| 3,830,161 | 8/1974 | Bacon | 104/70 |
| 3,838,657 | 10/1974 | Fleming | 104/183 |
| 3,853,067 | 12/1974 | Bacon | 104/70 |
| 3,854,415 | 12/1974 | Lamberet | 104/173.1 |
| 3,930,450 | 1/1976 | Symons | 104/73 |
| 4,149,469 | 4/1979 | Bigler | 104/73 |
| 4,299,171 | 11/1981 | Larson | 104/70 |
| 4,337,704 | 7/1982 | Becker et al. | 104/70 |
| 4,392,434 | 7/1983 | Durwald et al. | 104/70 |
| 4,725,398 | 2/1988 | Ruckey et al. | 104/183 |
| 4,823,705 | 4/1989 | Fukuda | 104/140 |
| 4,895,079 | 1/1990 | Beatty | 104/183 |
| 5,011,134 | 4/1991 | Langford | 272/56.5 R |
| 5,234,285 | 8/1993 | Cameron | 104/173.1 |
| 5,299,964 | 4/1994 | Hopkins | 114/346 |

FOREIGN PATENT DOCUMENTS

| | | | |
|---|---|---|---|
| 280336 | 8/1988 | European Pat. Off. | 104/183 |
| 192742 | 11/1937 | Switzerland | 104/173 |

*Primary Examiner*—Mark T. Le
*Attorney, Agent, or Firm*—Dennis T. Griggs

[57] ABSTRACT

Cable driven racing boats compete in a simulated race including forward and return heats. In the forward heat, the racing boats are accelerated along parallel guide channels from a forward launch station into a shallow splash lake, and then hydroplane to a forward heat finish line. In the return heat, the racing boats are accelerated through the same guide channels from a return launch station located on the opposite end of the splash lake. Passengers continue to face the reverse launch station as the racing boats plunge into the shallow splash lake and hydroplane to the return heat finish line. The racing boats are stabilized by centering wheels and by guide rollers that travel along the guide channels. The racing boats are clamped onto the drive cables, and the guide rollers are mounted for rotation on tow bars that are pivotally coupled to the drive cables. The centering rollers ride on rails that run in parallel with the guide channel, and the tow bars pull the guide rollers through a guide pocket in rolling engagement against a guide plate. High speed take-up reels located near the forward and return launching stations are coupled to opposite ends of the power drive cables for pull-pull power transmission. Start-up torque is provided by a shiftable flywheel, and electric motors drive the cables at hydroplaning speed.

10 Claims, 4 Drawing Sheets

AMUSEMENT POWER-CABLE-PROPELLED AND CHANNEL-GUIDED BOAT RIDE STRUCTURE

FIELD OF THE INVENTION

This invention relates generally to amusement watercraft, and in particular to a passenger boat ride in which passenger boats are propelled by power cables from a ground level launch or from an inclined launch through a watercourse.

BACKGROUND OF THE INVENTION

Amusement parks and theme parks such as Six Flags Over Texas, Opryland U.S.A., Cedar Point, Carowinds, Busch Gardens, Geauga Lake, Elitch Gardens and many others feature various watercraft rides that are guided safely through natural and man-made waterways. Some watercraft rides that are currently popular include a floating gardens ride, a river rapids ride, a log flume ride and a mill chute ride.

In a typical watercraft ride, a passenger boat is guided along a water channel from a passenger loading station to one or more intermediate stations and back to the passenger loading station. Such boats are usually propelled in part by water currents, gravity or passenger manpower, although some are propelled by motor-driven chains. Generally, variations such as music, sound effects, lighting effects, stage props and costumed characters enhance the entertainment value of the ride.

Some dominant concerns in the operation of such rides is the creation of a sense of fun and excitement while maintaining passenger safety, reliable equipment operation and expedited handling of passengers during loading and off-loading.

DESCRIPTION OF THE PRIOR ART

Conventional watercraft amusement rides are described in the following patents:

| U.S. Pat. No. | Inventor | Title of Invention |
|---|---|---|
| 357,790 | Schaefer | Marine Boat Slide |
| 849,970 | Boyton | Amusement Device |
| 3,404,635 | Bacon et al | Boat Amusement Ride |
| 3,830,161 | Bacon | Flume Boat Ride with a Double Downchute |
| 4,392,434 | Durwald et al | Turbulent Waterway |
| 3,853,067 | Bacon | Boat Amusement Ride with a Spillway |
| 4,299,171 | Larson | Demountable Flume Amusement Ride |
| 4,337,704 | Becker | Turbulent-Water Way |
| 4,149,469 | Bigler | Log Braking and Stabilizing System for Log Flume Ride |
| 5,011,134 | Langford | Waterslide with Uphill Run and Flotation Device Therefor |
| 3,690,265 | Horibata | Aquatic Sled and Shooting Apparatus Thereof |
| 5,299,964 | Hopkins | Amusement Raft Ride |
| 4,836,521 | Barber | Whirlpool Amusement Ride |
| 5,069,443 | Shiratori | Water Slider Lane |
| 5,282,772 | Ninomiya | Simulator for Shooting Down the Rapids |
| 4,391,201 | Bailey | Aquatic Toboggan Slide |
| 4,543,886 | Spieldiener | Amusement Ride Including a Rotating Loading Terminal |
| 3,923,301 | Myers | Amusement Water Slide |

-continued

| U.S. Pat. No. | Inventor | Title of Invention |
|---|---|---|
| | | and Method |
| 3,930,450 | Symons | Boat Ride for Amusement Park |
| 5,213,547 | Lochtfeld | Method and Apparatus for Improved Water Rides by Water Injection and Flume Design |
| 4,516,943 | Spieldiener | Amusement Ride Raft |

These patents disclose various watercraft amusement rides in which a passenger boat is propelled through a flume or guided down an inclined launch, and then recovered. For example, U.S. Pat. 849,970 discloses an inclined launch in which a pair of passenger boats are winched up dual tracks by sprocket-driven chains, are reversed on a turntable and then permitted to descend the launch by the force of gravity along the inclined tracks into a splash lake. The boats are guided by wheels along the guide tracks during descent.

U.S. Pat. 3,830,161 discloses a flume boat ride having dual launch chutes that guide amusement boats through a shallow body of water. A similar boat ride is shown in U.S. Pat. 3,404,635 in which a pair of passenger boats are guided from an elevated passenger loading station along dual tracks into a waterway.

U.S. Pat. 4,392,434 discloses an amusement boat ride in which a passenger boat is pulled by a chain drive to a launch station above a turbulent waterway. The passenger boat is then released from the chain drive and travels by gravity on guide wheels that roll along a guide track.

Conventional watercraft rides as exemplified by the patents discussed above broadly disclose the concept of guiding one or more amusement boats from an elevated launch into a waterway.

The operators of amusement parks are constantly striving to provide safe, yet thrilling and entertaining boat rides. Accordingly, there is a continuing interest in providing novel watercraft rides that offer passengers a memorable and exciting ride experience under closely controlled, safe operating conditions.

SUMMARY OF THE INVENTION

The amusement boat ride according to a first embodiment of the present invention is a simulated boat race in which a pair of racing boats compete in forward and return heats. Novel combinations of sudden acceleration/deceleration, high velocity travel, reversal of movement, exposure to lighting effects, sound effects, water spray and group competition provide a sense of excitement and fun. The passengers of each racing boat are subjected to high launch velocity, high speed hydroplaning across a splash lake, and giant water spray rooster tails that, in the spirit of good fun, spray onto passengers of the competing boat as well as onto nearby spectators. The racing boats are propelled along parallel guide channels from one launch station to the other by power drive cables that are coupled for pull-pull power transmission to high speed, motor-driven take-up reels located on opposite ends of the splash lake.

According to an alternative amusement ride of the present invention, a pair of passenger boats are launched from a first pair of inclined launch ramps and are propelled by the power drive cables along the inclined launch ramps into a shallow splash lake. The passenger boats are then accelerated along the parallel guide channels by the power drive cables so that the boats hydroplane across the splash lake. The power drive cables pull the passenger boats partially up inclined return ramps on the opposite end of the splash lake to a predetermined return launch elevation. Upon reaching the return launch elevation, the direction of drive cable movement is suddenly reversed and the passenger boats are propelled rapidly down the inclined return ramps with the passengers facing away from the direction of return travel. The passenger boats are then propelled along the guide channels across the shallow splash lake at hydroplaning speed, followed by coasting at a reduced speed to the passenger loading station.

In each embodiment, the passenger boats are stabilized by centering wheels and guide rollers that travel along a continuous, submerged guide channel. The passenger boats are clamped directly onto the power drive cables and the guide rollers are coupled to the power drive cables by pivotal tow bars. The centering rollers ride on submerged rails or guide support surfaces that run in parallel with the guide channel. The high speed take-up reels located near the forward and return launch stations are coupled to opposite ends of the power drive cables for pull-pull power transmission. Start-up torque is provided by high speed flywheels that are coupled to the take-up reels through a shiftable clutch, and the take-up reels are driven by electric motors at hydroplaning and coasting speeds.

BRIEF DESCRIPTION OF THE DRAWINGS

A preferred embodiment of the present invention will now be described with reference to the accompanying drawings in which.

DETAILED DESCRIPTION OF THE PREFERRED EMBODIMENTS

Figure 1:
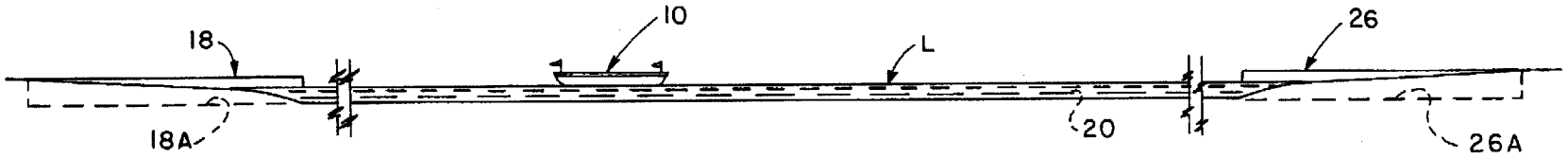
FIG. 1 is a simplified side elevational view, partially in section, of a simulated racing boat ride having launch stations on opposite ends of a splash lake.
Figure 2:
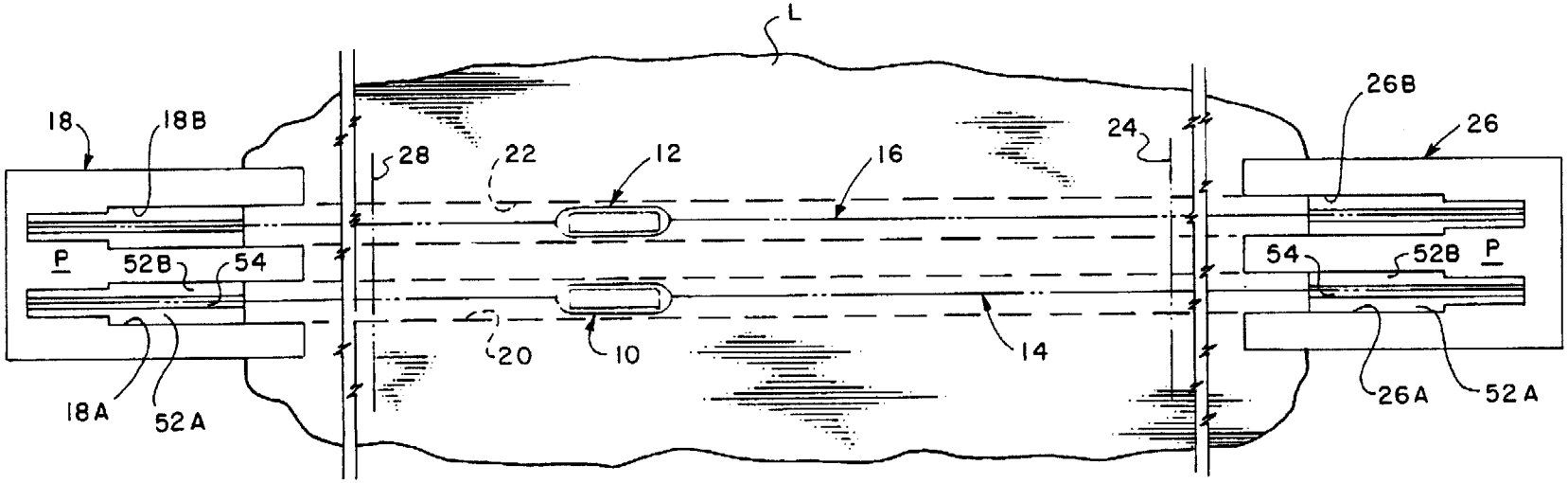
FIG. 2 is a top plan elevational view thereof.

In the description which follows, like parts are marked through the specification and drawings with the same reference numerals, respectively. The drawing figures are not necessarily to scale, and the proportions of certain parts have been exaggerated for sake of clarity.

Referring now to FIGS. 1–6, a simulated boat race is conducted in first and second heats in which a pair of racing boats 10, 12 are propelled by power drive cables 14, 16, respectively, from a forward launch station 18 at a hydroplaning speed, for example 0 m.p.h., along parallel guide channels 20, 22 across a shallow splash lake L to a first heat finish line 24. Large (twenty feet high) water spray rooster tails follow the passenger boats across the lake. The winning time of the first heat is announced and displayed on an electronic score board. The racing boats 10, 12 are then propelled at a coasting speed under drive cable control to a return launch station 26 on the opposite end of the splash lake.

The racing boats are held steady at the return launch station 26 during a second heat countdown, and then are suddenly accelerated along the guide channels 20, 22 into the shallow splash lake L in the reverse (return) direction to the second heat finish line 28, and the winning time of the second heat is announced and displayed. The passengers remain facing the return launch station (opposite to the direction of return travel) during the return heat as the racing boats hydroplane across the splash lake, thus permitting the passengers to watch closely as both boats generate the giant water spray rooster tails.

Figure 3:
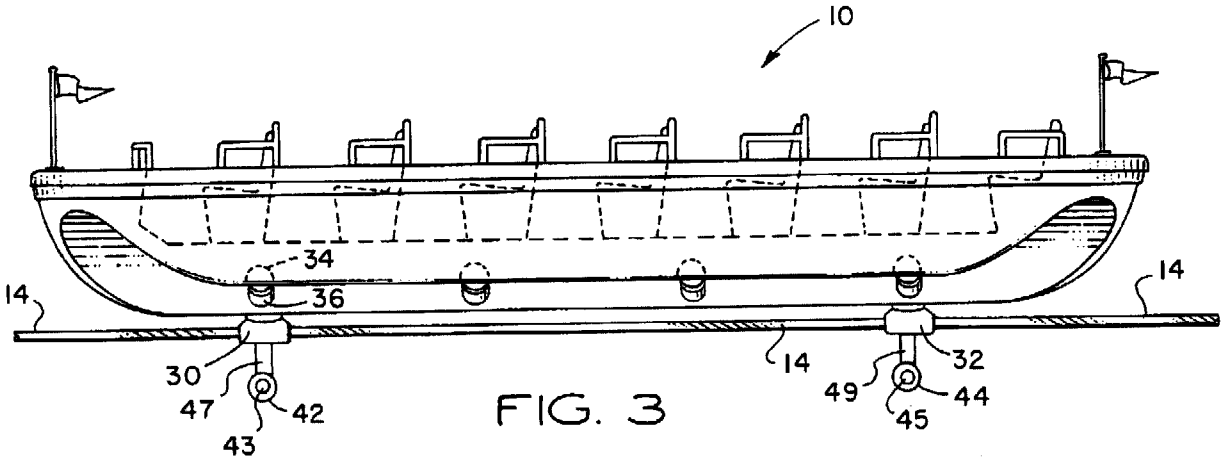
FIG. 3 is a side elevational view of a racing boat connected to a power drive cable.
Figure 5:
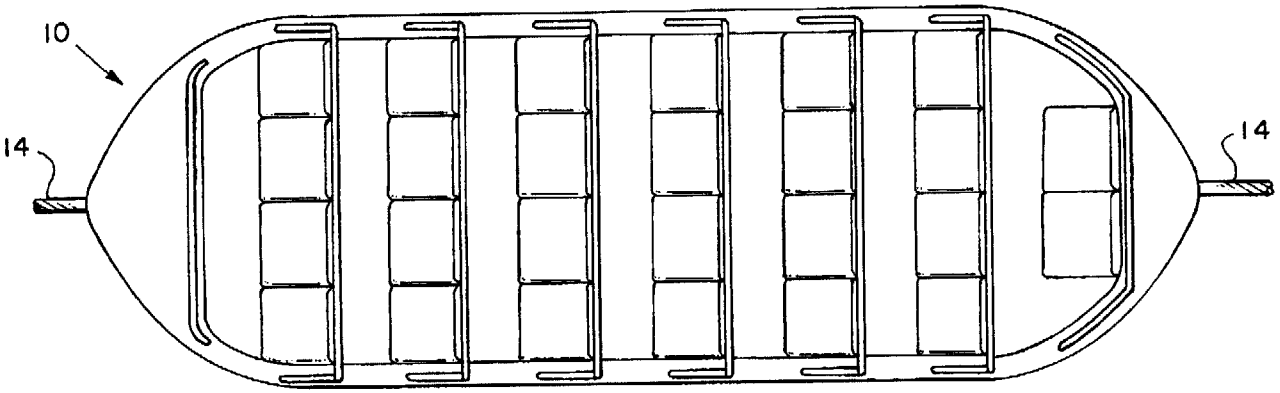
FIG. 5 is a top plan view thereof.
Figure 4:
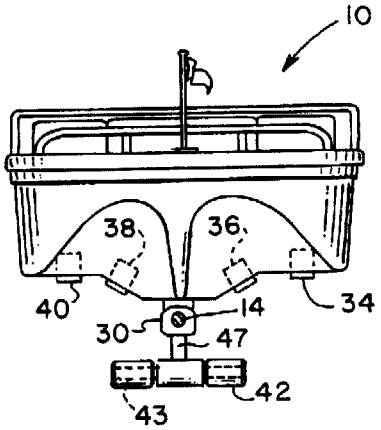
FIG. 4 is a front elevational view thereof.
Figure 6:
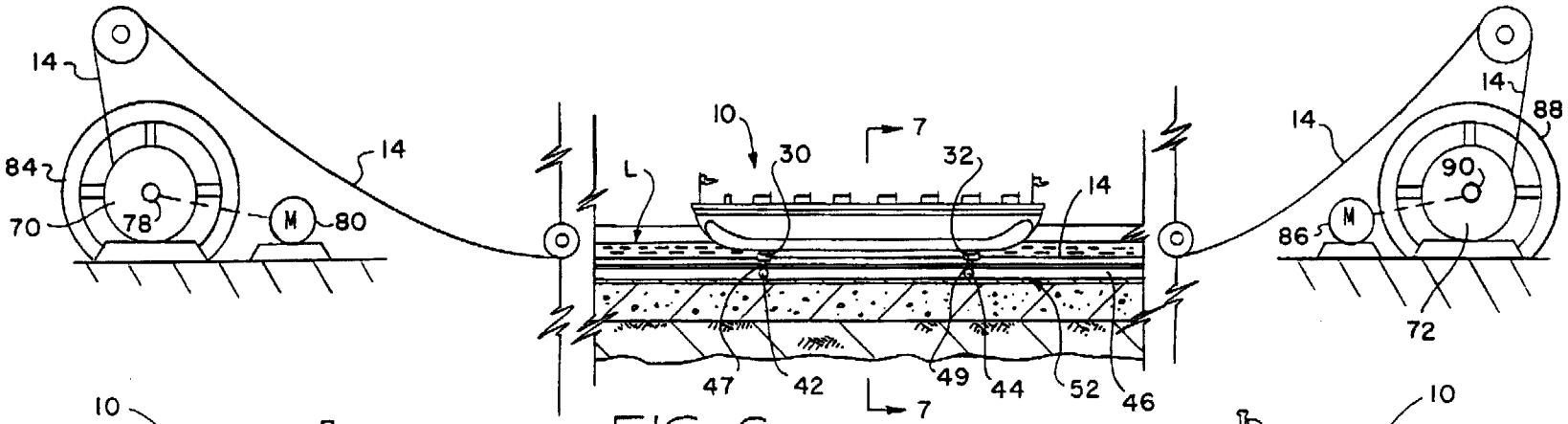
FIG. 6 is a side elevational view, partly in section, showing power drive cables connected for propelling a racing boat through a submerged guide channel.

The racing boats 10, 12 are propelled along the parallel guide channels 20, 22 by the power drive cables 14, 16 that are attached onto the underside of each racing boat, respectively, by cable tow clamps 30, 32 (FIG. 3). The power drive cables maintain positive control of the speed and relative positions of the racing boats at all times. The dual launch stations 18, 26 on opposite ends of the shallow splash lake L permit the passengers to experience rapid acceleration and hydroplaning across the splash lake at a high speed to the forward heat finish line 24, followed by hydroplaning across the splash lake at a high speed in the reverse (return) direction to the return heat finish line 28, with the boats being guided along the parallel guide channels 20, 22 during both heats.

Prior to the start of the first heat, the passengers are loaded onto the racing boats 10, 12 from a ground level staging platform P. After passenger loading has been completed, the racing boats 10, 12 are held in launch pens 18A, 18B at the forward launch station during the forward heat countdown. Upon launch, the racing boats are accelerated along the guide channels 20, 22 by the power cables 14, 16. As the racing boats exit the forward launch, they hydroplane across the shallow lake L at a high speed, for example of up to 40 miles per hour, thus creating giant water spray rooster tails as they approach the forward heat finish line 24.

After the racing boats 10, 12 cross the forward heat finish line, the power cables continue to drive the racing boats at a reduced (coasting) speed, for example 5 m.p.h., along the drive channels to the return launch station 26 on the opposite end of the splash lake. The racing boats are held in launch pens 26A, 26B during a second heat countdown and are then accelerated rapidly along the guide channels while the passengers remain facing the return launch station and the water spray rooster tails. The racing boats 10, 12 hydroplane across the shallow lake at a high speed under power drive cable control to the return heat finish line 28. The racing boats are then pulled by the power cables at a coasting speed, for example 5 m.p.h., to the staging platform P where the passengers are released and new passengers are loaded for the next race.

Preferably, each heat of the simulated boat race is accompanied by giant voice (public address) messages announcing departure, countdown, timing lights that indicate various stages during the countdown and loud warning sounds prior to launch. Synchronized sound effects and flashing light effects accentuate the acceleration of the launch. Compressed steam is released at each launch station as the racing boats initially accelerate across the splash lake. An electronic scoreboard flashes the winning time as the racing boats are guided under power cable control to each launch station. The special effects are repeated as the racing boats are propelled from the return launch station to the second heat finish line 28.

Referring now to FIG. 3, FIG. 4, FIG. 7 and FIG. 8, the power drive cables 14, 16 are securely attached to the underside of each passenger boat by cable tow clamps 30, 32. High velocity movement of each passenger boat is stabilized laterally and vertically by multiple sets of centering guide wheels 34, 36, 38, 40 (FIG. 4) that are mounted on the underside of each racing boat. Vertical pitching movement of each racing boat is stabilized by guide rollers 42, 44 and by the centering guide wheels. The guide rollers 42, 44 are confined for rolling movement within continuous guide pockets 46 that extend along the guide channels 20, 22, respectively, from the forward heat launch station 18 across the splash lake L to the reverse heat launch station 26. The guide rollers 42, 44 are mounted for rotatable movement on axles 43, 45, respectively. The roller axles 43, 45 are pivotally coupled to the cable tow clamps 30, 32 by tow bars 47, 49, respectively.

Figure 7:
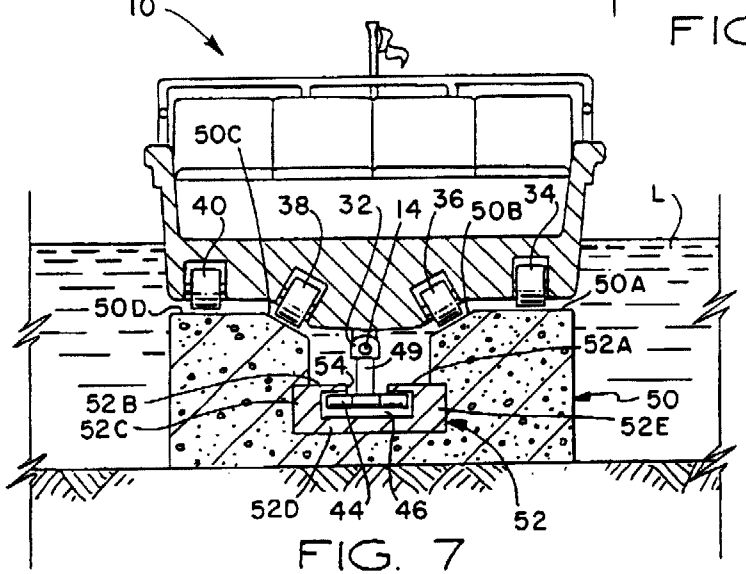
FIG. 7 is a sectional view thereof taken along the line 7—7 of FIG. 6 showing a first embodiment of a guide channel with centering surfaces.

Lateral movement of each racing boat is stabilized by the centering wheels 36, 38 and by the cable tow clamps 30, 32. As shown in FIG. 7, the centering wheels ride on channel guide surfaces 50A, 50B, 50C, 50D formed on a reinforced concrete guide platform 50. The guide surfaces cooperate with the power cable guide rollers 42, 44 for maintaining the racing boats centered horizontally and vertically within their respective guide channels 20, 22.

The guide pocket 46 forms a continuous runway through the concrete platform and is partially enclosed by a guide plate 52 that runs along the length of the guide platform 50. The guide plate 52 is intersected by a longitudinal slot 54 that also extends along the length of the guide pocket. The slot 54 provides a continuous keyway opening into the guide pocket 46 for receiving the tow bars 47, 49 and guide rollers. The guide rollers 42, 44 are mounted on the axles 43, 45 for rolling movement through the guide channel, with lateral movement being opposed by the sidewalls 52C, 52D, 52E of the guide plate 52. Downward (bottoming) pitching movement of each passenger boat is opposed by the guide support surfaces 50A, 50B, 50C and 50D of the concrete guide platform 50. Upward, vertical pitching movement of each passenger boat is opposed by engagement of the guide rollers 42, 44 against the underside of the guide plate flanges 52A, 52B.

Figure 8:
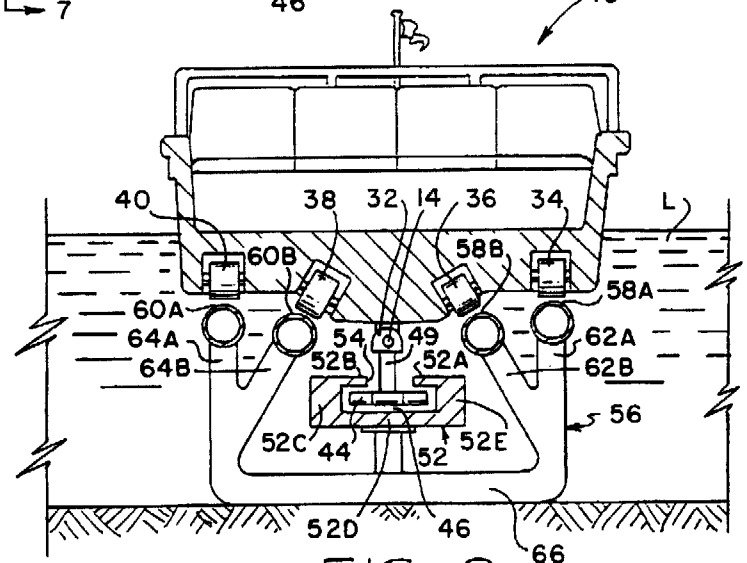
FIG. 8 is a sectional view similar to FIG. 7 showing an alternative guide channel arrangement.

Referring now to FIG. 8, a channel guide is formed by a tubular weldment 56 which is submerged within the splash lake L. The supporting and centering guide surfaces are formed by continuous, tubular support beams 58A, 58B and 60A, 60B. The tubular support beams are elevated from the lake bed by tubular struts 62A, 62B and 64A, 64B, respectively, which are welded to the support beams and to an integrally formed crossbar 66. In each embodiment, the guide rollers 42, 44 are confined for rolling movement within the guide pocket 46. The guide pocket 46, which is partially enclosed by steel flanges 52A, 52B and the longitudinal slot 54 thereby define a continuous, elongated keyway that permits free movement of the tow bars 47, 49 as the guide rollers travel along the guide pocket.

Figure 9:
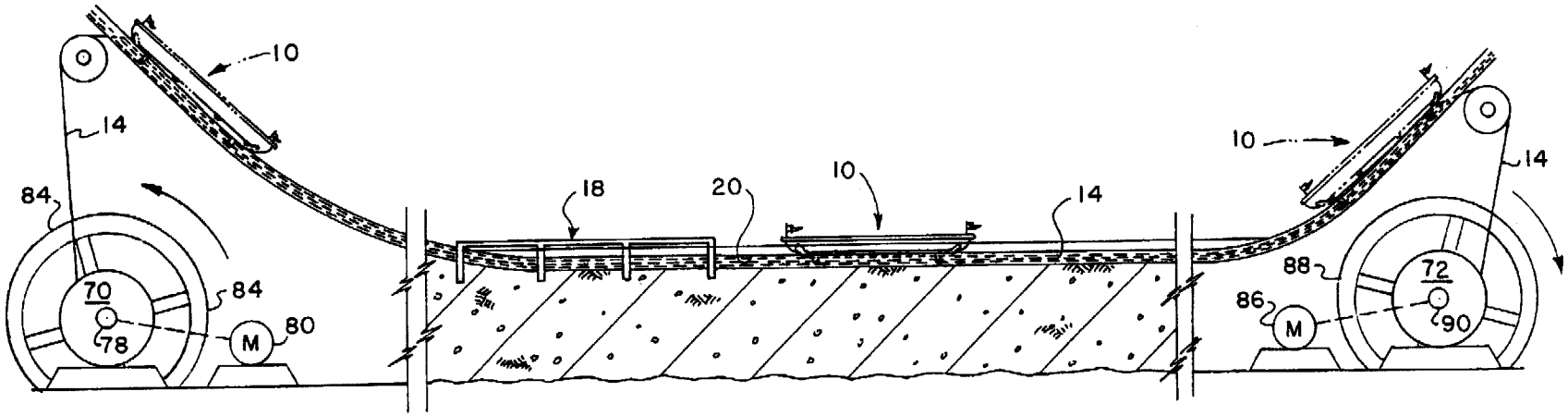
FIG. 9 is a view similar to FIG. 6 showing an amusement boat ride in which a pair of passenger boats are driven by power cables through a splash lake situated between a pair of inclined launch ramps; and, FIG. 10 is a top plan view thereof.
Figure 10:
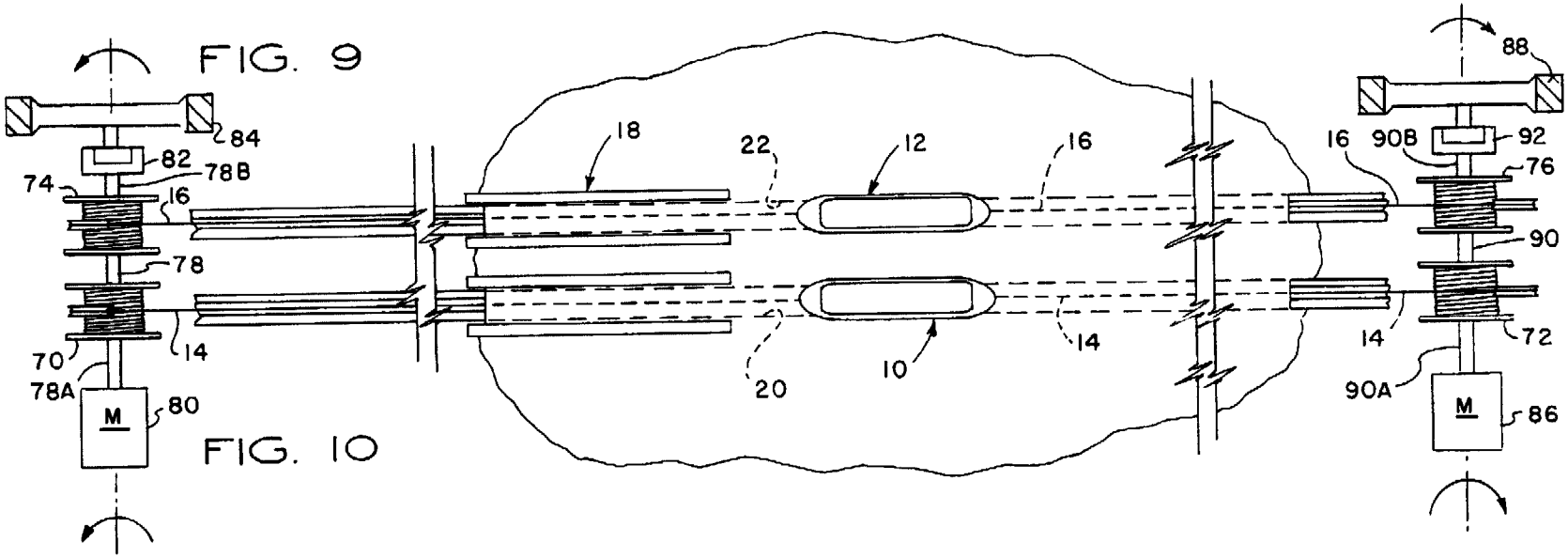

Referring now to FIG. 7, FIG. 9 and FIG. 10, the drive cables 14, 16 are maintained under tension for pull-pull power transmission by high speed, motor driven take-up reels 70, 72 and 74, 76 located on opposite ends of the splash lake L. The opposite end portions of the power drive cables 14, 16 are coupled in reeved engagement around the high speed take-up reels in a pull-pull power drive configuration. The take-up reels 70, 74 are mounted on a common power shaft 78. The power shaft 78 is coupled on one end 78A to an electric drive motor 80, and on its opposite end 78B to a shiftable clutch 82. The shiftable clutch is coupled to a high inertia flywheel 84. According to this tandem coupling arrangement, mechanical energy is stored in the flywheel 84 from the drive motor 80 during low to medium (coasting or hydroplaning) loading. The stored mechanical energy is made available during high loading periods (during launch), thereby supplying a high level of torque to quickly launch and accelerate the passenger boats to hydroplaning speed. The flywheel 84 is shifted on line as may be needed for launch and for assisting the electric drive motor in maintaining the electric motor 80 are used for maintaining the passenger boats at hydroplaning speed.

A return power drive assembly is located on the opposite end of the splash lake L as shown in FIGS. 9 and 10. The return power drive assembly includes high speed take-up reels 72, 76, an electric drive motor 86 and a flywheel 88. The high speed take-up reels 72, 76 are mounted on a common drive shaft 90, with one end portion 90A of the common drive shaft being coupled to the electric drive motor 86, and an opposite end portion 90B being coupled to a shiftable clutch 92. The flywheel 88 is coupled through the shiftable clutches 92 to provide start-up torque and maintain hydroplaning speed as previously discussed.

TABLE 1

| SIMULATED BOAT RACE | |
|---|---|
| Ground Space Requirements | 500 × 60 Ft. |
| Launch Chute Length | 100 Ft. |
| Brakes - positive drive cable control | |
| Propulsion - shiftable clutch flywheel launch, power cables driven by electric motors at hydroplaning and coasting speeds | |
| Positioning - guide wheels, centering wheels and dual tow bars under the boat | |
| Guide Channel Length | 300 Ft. |
| Boat Speed (Hydroplaning) | 40 M.P.H. |
| Number of Guide Channels | 2 |
| Boat Length | 25 Ft. |
| Boat Width | 8 Ft. |
| Passengers per Boat | 24 to 26 |

TABLE 2

| PASSENGER BOAT CLIMB | |
|---|---|
| Ground Space Requirements | 400 × 30 to 60 Ft. |
| Dock Lengths | 50 Ft. |
| Brakes - positive drive cable control | |
| Positioning - guide wheels, centering wheels and dual tow bars under the boat | |
| Guide Channel Length | 200 Ft. |
| Launch Chute Length | 100 Ft. |
| Launch Chute Elevation | 70 Ft. |
| Propulsion - shiftable clutch flywheel launch, power cables driven by electric motors at hydroplaning and coasting speeds | |
| Boat Speed (Hydroplaning) | 40 M.P.H. |
| Number of Guide Channels | 2 |
| Boat Length | 25 Ft. |
| Boat Width | 8 Ft. |
| Passengers Per Boat | 24 to 26 |

What is claimed is:

1. An amusement boat ride for carrying passengers across a watercourse comprising, in combination:

a first launch station disposed adjacent one end of the watercourse;

a second launch station disposed adjacent an opposite end of the watercourse;

means defining a guide channel extending through the watercourse from the first launch station to the second launch station;

a passenger boat movably coupled to the guide channel means for forward and return travel across the watercourse; and, power drive means including first and second take-up reels and a drive cable attached to the passenger boat, the drive cable having first and second end portions coupled in reeved engagement with the first and second take-up reels, respectively, and first and second drive motors coupled to the first and second take-up reels, respectively, for pull-pull power transmission to the power drive cable.

2. An amusement boat ride as defined in claim 1, the power drive cable extending from the first take-up reel through the guide channel to the second take-up reel for propelling the passenger boat from the first launch station across the watercourse to the second launch station and from the second launch station across the watercourse to the first launch station.

3. An amusement boat ride as set forth in claim 1, the guide channel means including a guide pocket, a guide plate forming a boundary of the guide pocket and a guide slot intersecting the guide plate along the guide channel from the first launch station to the second launch station;

a tow bar coupled to the power drive cable and extending through the guide slot into the guide pocket; and, a guide roller mounted for rotation on the tow bar, the guide roller being disposed in the guide pocket for rolling engagement against the guide plate.

4. An amusement boat ride as set forth in claim 1, wherein the guide channel means include at least two guide support surfaces extending transversely with respect to each other, further including:

at least first and second centering wheels mounted on the underside of the passenger boat for rolling engagement against the first and second guide support surfaces, respectively.

5. An amusement boat ride as set forth in claim 1, wherein the guide channel means include at least two tubular support beams extending in parallel with and laterally offset with respect to the guide pocket, further including:

at least two centering wheels mounted on the underside of the passenger boat for rolling engagement against the first and second tubular support beams, respectively.

6. An amusement boat ride as set forth in claim 1, the power drive means including:

first and second flywheels coupled to the first and second take-up reels, respectively.

7. In an amusement boat ride having a power cable connected to a passenger boat for carrying passengers across a watercourse, the improvement comprising:

power drive means including first and second take-up reels, the drive cable having first and second end portions coupled in reeved engagement with the first and second take-up reels, respectively, and first and second drive motors coupled to the first and second take-up reels, respectively, for pull-pull power transmission to the power drive cable.

8. An improved amusement boat ride as set forth in claim 7, further including:

first and second flywheels coupled in torque transfer engagement with the first and second take-up reels and the first and second drive motors, respectively.

9. In an amusement boat ride having a passenger boat for carrying passengers across a watercourse, and having a power drive cable connected to the passenger boat and extending through a guide channel submerged in the watercourse, the improvement comprising:

a guide plate including an underside surface forming a boundary of the guide channel, and a guide slot intersecting the guide plate along the guide channel;

a tow bar coupled to the passenger boat and extending through the guide slot into the guide channel; and, a guide roller mounted for rotation on the tow bar, the guide roller being disposed in the guide channel for rolling engagement against the underside surface of the guide plate.

10. An amusement boat racing apparatus comprising:

a pair of parallel first launch stations disposed adjacent one end of a watercourse;

a pair of parallel second launch stations disposed adjacent an opposite end of the watercourse;

a pair of parallel guide structures submerged in the watercourse and extending from the first launch stations to the second launch stations;

a pair of passenger boats movably coupled to the guide structures for forward and return travel across the watercourse; and power drive means attached to the passenger boats and movably coupled to the guide structures for simultaneously guiding and propelling the passenger boats across the watercourse.

* * * * *

UNITED STATES PATENT AND TRADEMARK OFFICE

CERTIFICATE OF CORRECTION

PATENT NO. : 5,732,635

DATED : Mar. 31, 1998

INVENTOR(S) : Errol W. McKoy

It is certified that error appears in the above-indentified patent and that said Letters Patent is hereby corrected as shown below:

Column 3, line 67, "0" should be -- 40 --.

Column 8, Claim 10, line 39, "paralleI" should be -- parallel --.

Signed and Sealed this

Thirtieth Day of June, 1998

*Attest:*

*Attesting Officer*

BRUCE LEHMAN

*Commissioner of Patents and Trademarks*